United States Patent [19]

Jones et al.

[11] 3,997,943

[45] Dec. 21, 1976

[54] BAG CLOSURE CLIP

[75] Inventors: Elwyn David Jones, Beloeil; John Michael Charles Ridden, Otterburn Park, both of Canada

[73] Assignee: Canadian Industries Limited, Montreal, Canada

[22] Filed: Jan. 23, 1976

[21] Appl. No.: 651,695

[30] Foreign Application Priority Data

Feb. 18, 1975 United Kingdom ..... 6774/75

[52] U.S. Cl. ..... 24/30.5 P; 24/16 PB

[51] Int. Cl.[2] ..... B65D 63/00

[58] Field of Search ..... 24/16 R, 16 PB, 17 R, 24/17 AP, 17 A, 17 B, 206 A

[56] References Cited

UNITED STATES PATENTS

| | | | |
|---|---|---|---|
| 2,554,105 | 5/1951 | Heinle | 24/16 PB |

FOREIGN PATENTS OR APPLICATIONS

| | | | |
|---|---|---|---|
| 647,389 | 7/1928 | France | 24/17 AP |
| 1,028,527 | 2/1953 | France | 24/17 AP |
| 1,075,876 | 4/1954 | France | 24/30.5 P |
| 1,281,537 | 12/1961 | France | 24/16 PB |
| 1,435,102 | 3/1966 | France | 24/16 PB |
| 381,603 | 10/1964 | Switzerland | 24/16 PB |
| 1,023,438 | 3/1966 | United Kingdom | 24/16 PB |

*Primary Examiner*—Donald A. Griffin
*Attorney, Agent, or Firm*—Donald G. Ballantyne

[57] ABSTRACT

A bag closure clip fabricated from an elongated double ply plastic strap, one end of which serves as a loop hanger, the closure being in the form of a noose made by passing the looped end of the strap through an aperture in the opposite strap end. The clip can replace the wire closure commonly employed for closing and carrying plastic bags containing blasting agents.

5 Claims, 3 Drawing Figures

BAG CLOSURE CLIP

Figure 1:
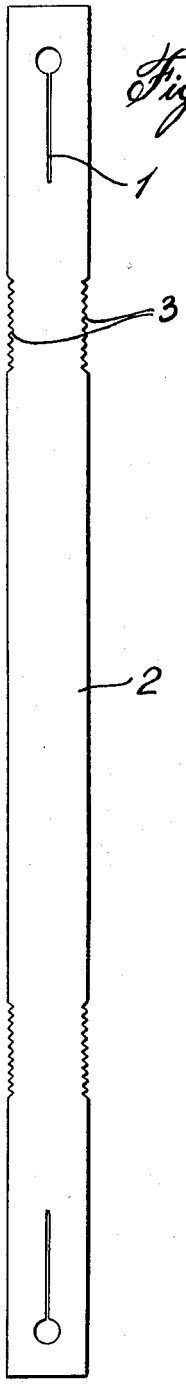

This invention relates to a device for closing flexible containers and connecting said closed containers to a transport mechanism, such as a hook.

Bags constitute a conventional means for packaging solid materials such as cement or fertilizer. Such bags have traditionally been fabricated from cloth or paper. More recently, bags of plastic polymers such as polyethylene have found extensive use in packaging applications. Such plastic bags have the advantage of being waterproof.

For most packaging applications, means must be provided for closing the bags. This may be by stitching or by a tying device. In some packaging applications such as in food casings and containers for explosives, it is necessary to provide means for attaching the package to a support. It is convenient to employ the same device both as a closure and as a hanger for attachment to support. It is known to employ wire for this purpose but wire closure devices have a tendency to cut plastic containers, causing leakage of the contents.

A closure clip has now been devised which effectively closes a flexible container such as a plastic bag and at the same time serves as hanger, the hanging tension applied to the clip serving to tighten the closure. The clip can be fabricated from material such as polymer film, thus minimizing possible damage to the closure area of the container.

Thus the primary object of the invention is to provide a closure clip that effectively closes a flexible container and at the same time serves as a hanger for attachment to a support. Additional objects will appear hereinafter.

The closure clip of this invention comprises an elongated generally flat member made of two strips of flexible plastic material, the strips being joined at one extremity to form a loop, the other extremities of the strips having matching apertures, each aperture having an area greater than the cross sectional area of the loop so that the loop can be inserted through both apertures to form a closure clip with loop hanger. The clip can be fabricated from a single strip of material folded about its midpoint, matching apertures being formed at both extremities of the strip. A stronger clip can be prepared by utilizing double or multiple ply plastic material to form the strip. Alternatively, the clip can be fabricated from a section of flattened plastic tubing, one folded border of the tubing constituting the loop, matching apertures being formed in both walls of the tubing adjacent to the opposing folded border.

The apertures can conveniently be in the form of a key hole, the enlarged part of the aperture being adjacent to the extremity of the strip. This configuration of the aperture lessens the tendency to rupture of the plastic strip.

It is also of advantage to form serrations in the strip at the position that contacts the aperture after closure. This assists in locking the clip about the bag being closed. However, plastic film employed to fabricate the clip may be sufficiently pliable to bunch up in the aperture and lock the closure clip.

Figure 2:
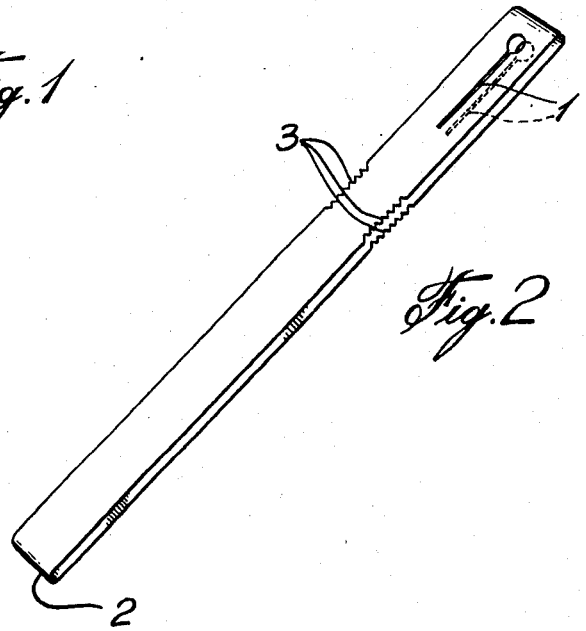
Figure 3:
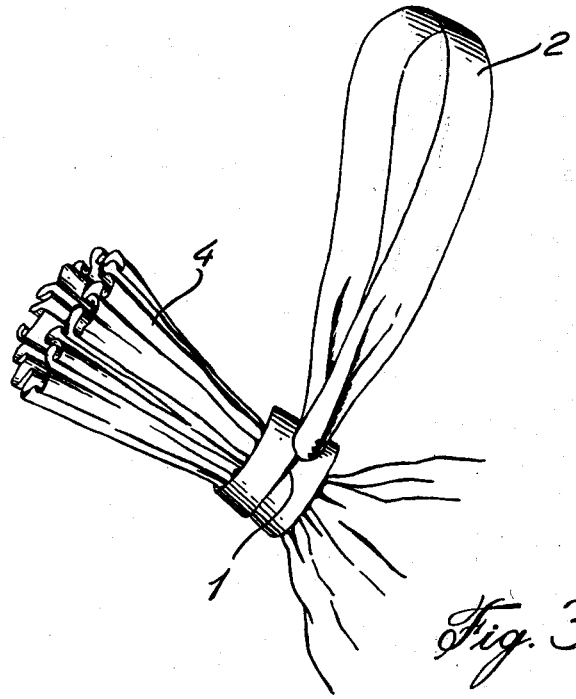

The invention is illustrated by way of example in the accompanying drawings wherein FIG. 1 is a plan view of one embodiment of the invention in open configuration, FIG. 2 is a perspective view of another embodiment of the invention, and FIG. 3 is a perspective view of the invention in use as a bag closure.

Referring to the drawings the apertures of the clip are shown at 1. In the drawing the apertures are keyhole-shaped with the enlarged part of the keyhole located adjacent the extremity of the clip. The embodiment illustrated in FIG. 1 is in the form of a single ply strip of plastic material with apertures located adjacent to both extremities. The embodiment illustrated in FIG. 2 is fabricated from a section of flattened tubing with two superimposed apertures adjacent to one extremity.

The loop hanger is formed in the clip of FIG. 1 by folding the strip about its midpoint 2 so that the two apertures are superimposed. In the clip of FIG. 2 the loop hanger is constituted by an edge fold 2 of the tubing. It is of advantage to provide serrations 3 at positions that contact aperture 1 after closure of the bag.

In FIG. 3 is shown the clip in use to close a bag 4. Loop 2 has been inserted through both apertures 1 and the clip drawn tight about the bag neck. In this case the clip was not serrated but the clip material was sufficiently flexible to bunch up in the large part of the keyhole-shaped aperture. FIG. 3 also indicates that when the bag is supported by a hook inserted through loop 2 the tension introduced by the weight of the bag will serve to tighten the clip.

A suitable material for fabrication of the clip of this invention is polyethylene film.

The closure clip of this invention has utility as a closure and hanger for flexible containers such as plastic bags. When used as a hanger, the closure is maintained tight by the tension caused by the weight of the container and contents.

The closure clip of this invention has particular utility as a closure device for plastic bags used to package dry blasting agents. In this application the closed bags must be lowered into a bore hole. Conventionally, the closures for such use have been made of wire. The bags were lowered into the bore hole by means of a hook inserted through a loop of the wire tie. This known method of closure had the disadvantage that the wire had a tendency to cut the plastic bag allowing leakage of the blasting agent. Owing to the strip form of the closure clip of the present invention the tendency to cut into the bag is minimized.

What we claim is:

1. A closure clip comprising an elongated generally flat member made of two strips of flexible plastic material, the strips being joined at one extremity to form a loop, the other extremities of the strips having matching apertures, each aperture having an area greater than the cross-sectional area of the loop so that the loop can be inserted through both apertures to form a closure clip with loop hanger, the said strips being serrated at the positions that contact the apertures after closure has been completed.

2. A closure clip as claimed in claim 1 wherein the clip is made from a single strip of plastic material folded about its midpoint with matching apertures being formed at both extremities of the strip.

3. A closure clip as claimed in claim 1 wherein multiple ply plastic material is employed to make the closure clip.

4. A closure clip as claimed in claim 1 wherein the clip is made from a section of flattened plastic tubing, one folded border of the tubing constituting the loop, with matching apertures being formed in both walls of the tubing adjacent to the opposing folded border.

5. A closure clip as claimed in claim 1 wherein the apertures are in the form of keyholes, the enlarged portion being adjacent to the extremity of the closure clip.

* * * * *